US007507899B2

(12) United States Patent
Sumita

(10) Patent No.: US 7,507,899 B2
(45) Date of Patent: Mar. 24, 2009

(54) AUTOMATIC MUSIC TRANSCRIPTION APPARATUS AND PROGRAM

(75) Inventor: Ren Sumita, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 0 days.

(21) Appl. No.: 12/016,451

(22) Filed: Jan. 18, 2008

(65) Prior Publication Data

US 2008/0210082 A1 Sep. 4, 2008

Related U.S. Application Data

(63) Continuation of application No. PCT/JP2006/300071, filed on Jan. 6, 2006.

(30) Foreign Application Priority Data

Jul. 22, 2005 (JP) ..... 2005-212060

(51) Int. Cl.
*G10H 1/00* (2006.01)

(52) U.S. Cl. ..... 84/609; 84/649; 84/600

(58) Field of Classification Search ..... 84/600–602, 84/609, 649

See application file for complete search history.

(56) References Cited

U.S. PATENT DOCUMENTS 5,196,639 A * 3/1993 Lee et al. ..... 84/603
5,367,117 A 11/1994 Kikuchi
5,466,882 A * 11/1995 Lee ..... 84/603
5,615,302 A * 3/1997 McEachern ..... 704/209
5,960,373 A * 9/1999 Fukuda et al. ..... 702/76
6,560,341 B1 * 5/2003 Coyle ..... 381/63
2005/0149321 A1 * 7/2005 Kabi et al. ..... 704/207
2006/0065107 A1 * 3/2006 Kosonen ..... 84/616
2006/0075881 A1 * 4/2006 Streitenberger et al. ..... 84/609
2006/0075883 A1 * 4/2006 Thorne et al. ..... 84/616
2006/0075884 A1 * 4/2006 Streitenberger et al. ..... 84/616
2006/0095254 A1 * 5/2006 Walker et al. ..... 704/207
2007/0163425 A1 * 7/2007 Tsui et al. ..... 84/609
2008/0103763 A1 * 5/2008 Shimura et al. ..... 704/200.1
2008/0115656 A1 * 5/2008 Sumita ..... 84/612
2008/0188967 A1 * 8/2008 Taub et al. ..... 700/94
2008/0202321 A1 * 8/2008 Goto et al. ..... 84/616
2008/0210082 A1 * 9/2008 Sumita ..... 84/603
2008/0262836 A1 * 10/2008 Goto et al. ..... 704/207

FOREIGN PATENT DOCUMENTS

JP 4-195196 A 7/1992
JP 4-261591 A 9/1992
JP 7-199951 A 8/1995
JP 2000-293188 A 10/2000
JP 2001-265330 A 9/2001

* cited by examiner

*Primary Examiner*—David S. Warren
(74) *Attorney, Agent, or Firm*—Sughrue Mion, PLLC

(57) ABSTRACT

An automatic music transcription apparatus that can automatically transcribe a monophonic or polyphonic signal produced by a single musical instrument is provided. The apparatus includes an input block, an overtone-power-ratio detection block, a storage block, a chromatic-note-power detection block, an overtone elimination block for subtracting the product of the power of the fundamental note and the power ratio of each overtone corresponding to the chromatic note of the fundamental note from the power of the chromatic note of the overtone and adding the product of the power of the fundamental note, a musical-notation-information detection block, and a detection result output block for outputting the detected musical notation information to a file or the like.

4 Claims, 10 Drawing Sheets

(CONTINUE)

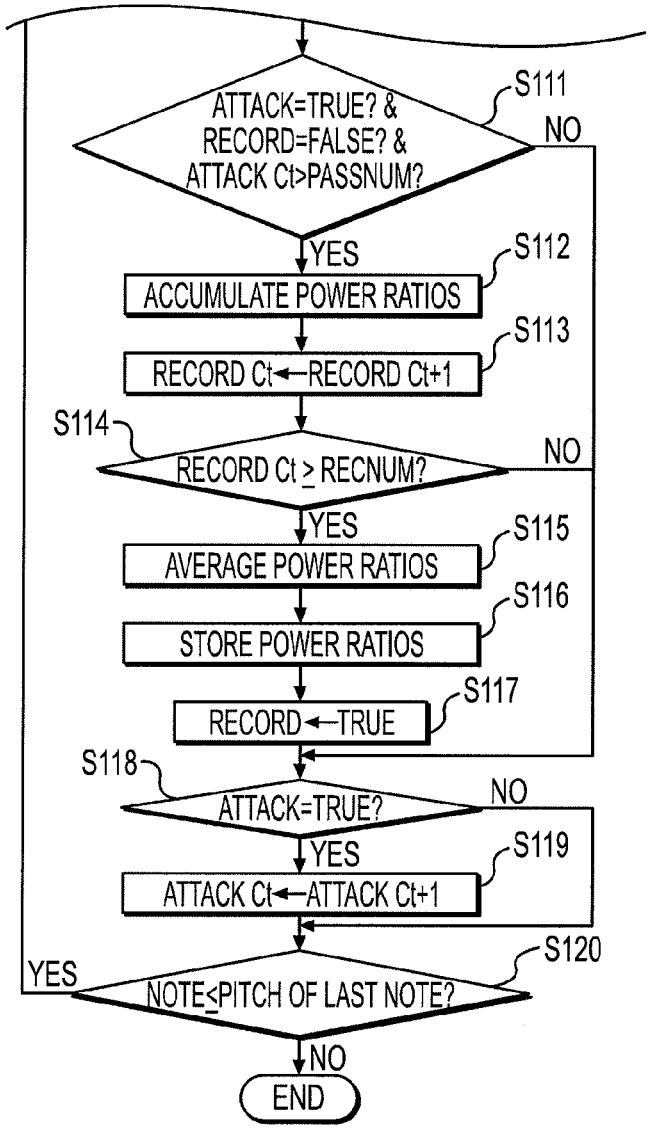
*(FIG. 5 CONT.)*

A GRAPH SHOWING THE POWER OF EACH CHROMATIC NOTE AFTER THE POWER OF THE ELIMINATED OVERTONE COMPONENT IS ADDED TO THE POWER OF THE FUNDAMENTAL NOTE

C6

C3

AUTOMATIC MUSIC TRANSCRIPTION APPARATUS AND PROGRAM

BACKGROUND OF THE INVENTION

1. Field of the Invention

The present invention relates to an automatic music transcription apparatus and program.

2. Discussion of Background

Since the act of writing down audio information taken from a music CD or the like, which is called music transcription, can be done only by people having musical knowledge and special capabilities such as perfect pitch, it has long been studied to have a computer or the like do the work.

One factor that makes it difficult to transcribe music automatically by a computer is overtones of a note produced by a musical instrument.

When a single note is produced by a musical instrument, the frequencies of the fundamental note (fundamental wave) and a plurality of overtones (harmonics) corresponding to the degree of highness (pitch) of the sound are generated at the same time. Although the overtone frequencies are usually integer multiples of the fundamental note, it is known that the frequencies of high-order overtones of the piano are not integer multiples of the fundamental note.

The ratio of the power of each overtone to the power of the fundamental note depends on the musical instrument. Even in the same musical instrument, the power ratio varies with the pitch of the sound and with time after the key is depressed or the sound is produced. Strictly speaking, each produced sound has a different power ratio, depending on the way the key is touched or the way the sound is produced (tonguing and the like), even if the same note is made by the same instrument.

The state of a single note is complicated, as described above, and when a plurality of notes are sounded simultaneously, the state becomes even more complicated. If some fundamental notes or overtones of the plurality of the simultaneously produced notes have close frequencies, the powers of the fundamental notes or overtones change because the phases cancel out each other or overlap with each other.

In automatic music transcription, the pitch of an instrumental note is extracted by detecting the frequency of the fundamental note of the instrument. However, because the overtone-to-fundamental power ratio varies with many conditions, it is not easy to judge whether the note is a fundamental note or an overtone. This fact has made it difficult to transcribe music automatically.

One method to eliminate those overtones is disclosed in JP-A-2000-293188, for instance. On the assumption that the power ratio generally depends on the musical instrument, the method disclosed in this reference determines whether a frequency (comparison frequency) higher than a frequency of interest is an overtone of the frequency of interest, and if yes, reduces the sound volume of the comparison frequency by a certain ratio and adds the reduced sound volume to the sound volume of the frequency of interest under certain circumstances.

If the power ratio almost depends on the musical instrument, the method described above would be effective. Actually, many musical instruments have power ratios greatly varying depending on ranges, so that overtones might not be properly eliminated by a certain ratio in some ranges.

The conventional structure reduces the sound volume of the comparison frequency (overtone) by a certain ratio, but the comparison frequency may contain the sound volume of overtones of another note sounding at the same time. The sound volume of the comparison frequency should not be reduced by a certain ratio; instead, the sound volume of the frequency of interest (fundamental note) multiplied by a ratio depending on the order of the overtone of the comparison frequency should be reduced from the sound volume of the comparison frequency.

SUMMARY OF THE INVENTION

In view of the problems described above, it is an object of the present invention to provide an automatic music transcription apparatus that automatically transcribes acoustic signals produced by a single musical instrument and also automatically transcribes acoustic signals produced not only in monophonic music but also in polyphonic music, where a plurality of notes are sounded at the same time.

Another object of the present invention is to provide an automatic music transcription program for implementing the apparatus on a computer.

To achieve one of the foregoing objects, the present invention provides an automatic music transcription apparatus. The apparatus includes input means for receiving an acoustic signal; overtone-power-ratio detection means for detecting beforehand overtone-to-fundamental power ratios of an input sample acoustic signal of a musical instrument used in music to be transcribed automatically; storage means for storing the overtone-to-fundamental power ratios; chromatic-note-power detection means for detecting the power of each chromatic note from the acoustic signal input from the musical instrument; overtone elimination means for subtracting, on the assumption that each chromatic note is a fundamental note, the product of the power of the fundamental note and the power ratio of each overtone corresponding to the chromatic note of the fundamental note from the power of the chromatic note of the overtone and adding the product to the power of the fundamental note, with respect to all the chromatic notes, one after another from the lowest chromatic note; and musical-notation-information detection means for detecting musical notation information by extracting a chromatic note having a power greater than or equal to a threshold level after the overtone elimination means performs the processing.

In the structure described above, the overtone-power-ratio detection means detects beforehand the overtone-to-fundamental power ratios of the musical instrument used in music to be transcribed automatically, and the storage means stores the power ratios. Next, the chromatic-note-power detection means detects the power of each chromatic note from the acoustic signal input from the input means. Then, the overtone elimination means subtracts, on the assumption that each chromatic note is a fundamental note, the product of the power of the fundamental note and the power ratio of each overtone corresponding to the chromatic note of the fundamental note from the power of the chromatic note of the overtone and adds the product to the power of the fundamental note. Those steps are executed for all the chromatic notes one after another, from the lowest chromatic note. Finally, the musical-notation-information detection means detects musical notation information by extracting a chromatic note having a power greater than or equal to the threshold level.

The overtone-power-ratio detection means preferably detects the overtone-to-fundamental power ratios, by using overtone-to-fundamental power ratios provided for some chromatic notes beforehand, by generating overtone-to-fundamental power ratios of the other chromatic notes through interpolation in accordance with the available power ratios given to a higher or lower chromatic note or both higher and lower chromatic notes, and by outputting the overtone-to-fundamental power ratios of the chromatic notes.

The base music information used in the structure of the present invention is taken from music played by a single musical instrument, and this music can be both monophonic and polyphonic, which means that a plurality of notes are produced at the same time.

Prior to automatic music transcription, some chromatic notes played on the target musical instrument are taken, and the overtone-to-fundamental power ratios are measured from those notes. The overtone-to-fundamental power ratios strongly vary immediately after the key is pressed or the sound is produced, and stabilizes in the process of attenuation. Accordingly, the power ratios should be taken in the attenuation process.

It is desired that the power ratios be measured for all chromatic notes in the range of the musical instrument whose music is to be automatically transcribed, but such preparation would take a long time. Originally, the power ratios express the tones of the musical instrument, and the tones of the musical instrument smoothly vary as the pitch of the sound changes. Therefore, the preferred structure described above measures the power ratios of some discrete notes (chromatic notes at intervals of major third, for instance) in the range of the musical instrument and generates power ratios of the other notes through interpolation in accordance with the power ratios of higher and lower notes.

Another structure provided by the present invention specifies a computer-executable program that implements the functions of the above-described structure on a computer. The computer-readable-and-executable program implements the above-described means structured to solve the problems described above, by using the computer configuration. The computer here means any machine including a central processing unit, such as a general computer including a central processing unit and a machine specially designed for specific processing.

When the program for implementing the above-described means on a computer is read out to the computer, the same functional means as those specified in the above-described structure are implemented.

To achieve one of the foregoing objects, the present invention provides an automatic music transcription program for causing a computer to function as the following means: input means for receiving an acoustic signal; overtone-power-ratio detection means for detecting beforehand overtone-to-fundamental power ratios of an input sample acoustic signal of a musical instrument used in music to be transcribed automatically; storage means for storing the overtone-to-fundamental power ratios; chromatic-note-power detection means for detecting the power of each chromatic note from the acoustic signal input from the musical instrument; overtone elimination means for subtracting, on the assumption that each chromatic note is a fundamental note, the product of the power of the fundamental note and the power ratio of each overtone corresponding to the chromatic note of the fundamental note from the power of the chromatic note of the overtone and adding the product to the power of the fundamental note, with respect to all the chromatic notes one after another, from the lowest chromatic note; and musical-notation-information detection means for detecting musical notation information by extracting a chromatic note having a power greater than or equal to a threshold level after the overtone elimination means performs the processing.

Another preferred structure provided by the present invention specifies a computer-executable program that implements the functions of the above-described preferred structure on a computer. When the program for implementing the above-described means on the computer is read out to the computer, the same functional means as those means specified in the above-described preferred structure are implemented.

The overtone-power-ratio detection means preferably detects the overtone-to-fundamental power ratios, by using overtone-to-fundamental power ratios provided for some chromatic notes beforehand, by generating overtone-to-fundamental power ratios of the other chromatic notes through interpolation in accordance with the available power ratios given to a higher or lower chromatic note or both higher and lower chromatic notes, and by outputting the overtone-to-fundamental power ratios of the chromatic notes.

By using one of the programs structured as described above together with an existing hardware resource, the corresponding apparatus of the present invention can be easily implemented as a new application using the existing hardware resource.

The programs can be easily used, distributed, and sold through communication or the like. If one of the programs is used on an existing hardware resource, the corresponding apparatus of the present invention can be easily implemented as a new application on the existing hardware resource.

A part of the functions provided by the functional means implemented by one of the above-described programs may be implemented by functions incorporated in the computer (the functions may be incorporated in the computer as hardware or may be implemented by an operating system or another application program running on the computer). The program may include an instruction for calling or linking the function implemented by the computer.

This is because the same structure can be virtually provided when a part of the functional means specified in one of the above-described apparatuses is executed by a part of the functions implemented by the operating system or the like, and the part of the functions implemented by the operating system or the like can be called or linked even though a program or module for implementing the functions does not exist.

The automatic music transcription apparatuses according to the present invention and the automatic music transcription programs according to the present invention can offer the advantages that an acoustic signal produced by a single musical instrument can be transcribed automatically, not only in monophonic music but also in polyphonic music, where a plurality of notes are sounded at the same time.

DETAILED DESCRIPTION OF THE PREFERRED EMBODIMENTS

An embodiment of the present invention will be described with reference to the drawings.

Figure 1:
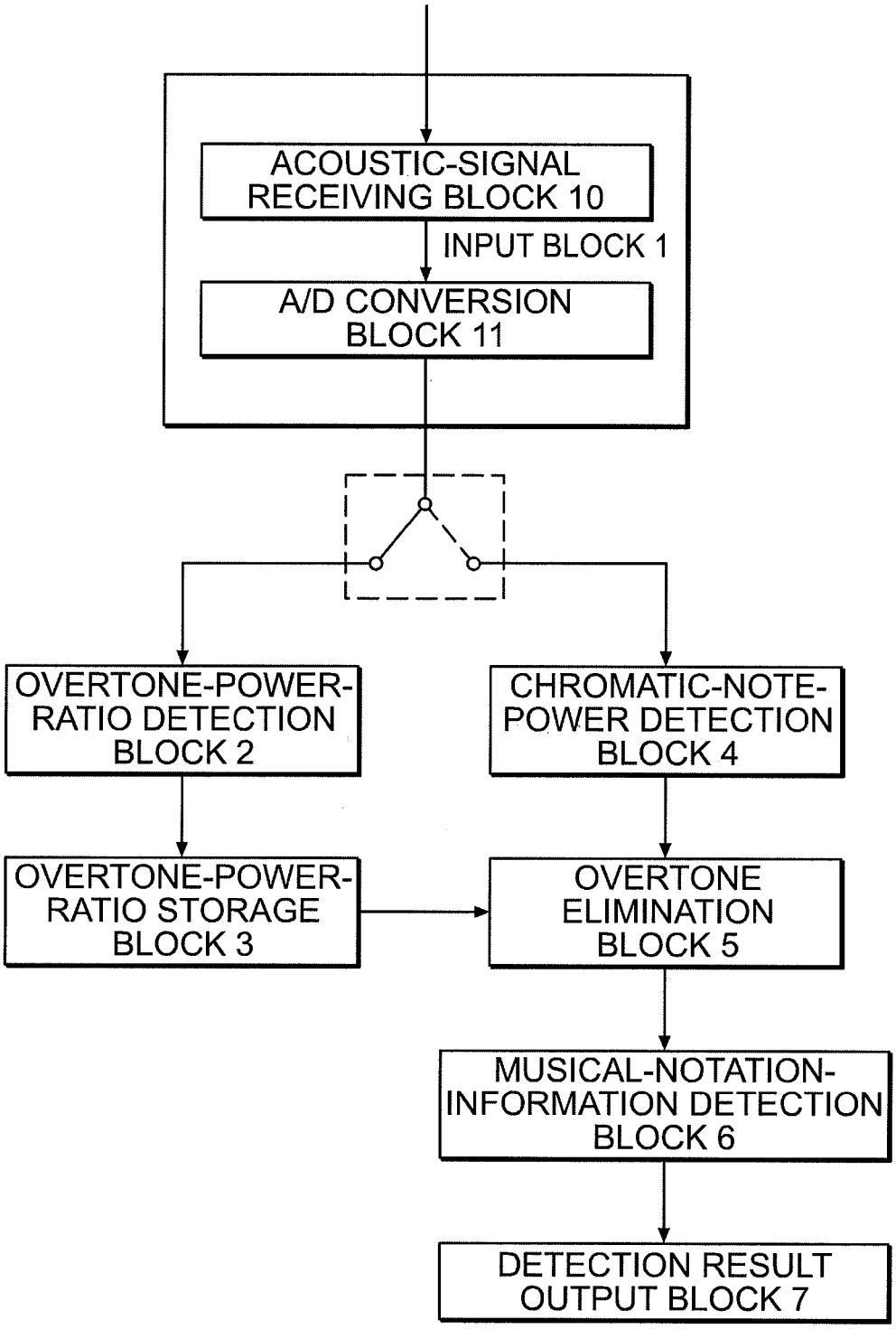
FIG. 1 is a block diagram of an automatic music transcription apparatus according to an embodiment of the present invention.

FIG. 1 is a general block diagram of an automatic music transcription apparatus according to an embodiment of the present invention.

The apparatus shown in the figure includes an input block 1 for receiving an acoustic signal; an overtone-power-ratio detection block 2 for detecting beforehand overtone-to-fundamental power ratios (hereinafter also called overtone power ratios) of an input sample acoustic signal of a musical instrument used in music to be transcribed automatically; an overtone-power-ratio storage block 3 for storing the overtone power ratios; a chromatic-note-power detection block 4 for detecting the power of each chromatic note from the acoustic signal input from the musical instrument; an overtone elimination block 5 for subtracting, on the assumption that each chromatic note is a fundamental note, the product of the power of the fundamental note and the power ratio of each overtone corresponding to the chromatic note of the fundamental note from the power of the chromatic note of the overtone and adding the product to the power of the fundamental note, with respect to all the chromatic notes, one after another from the lowest chromatic note; a musical-notation-information detection block 6 for detecting musical notation information by extracting a chromatic note having a power greater than or equal to a threshold level, after the overtone elimination block performs the processing; and a detection result output block 7 for outputting the detected musical notation information to a file or the like.

The input block 1 includes an acoustic-signal receiving block 10 and an A/D conversion block 11. The acoustic-signal receiving block 10 includes a microphone or other devices and has a function to take in an analog signal.

The A/D conversion block 11 has a function to convert the analog signal to a digital signal. After the A/D conversion, the sampling frequency is 11,025 Hz, and the quantization bit count is 16.

When the overtone power ratio is measured, the digital signal is sent to the overtone-power-ratio detection block 2. When a played sound is transcribed, the signal is sent to the chromatic-note-power detection block 4.

Figure 2:
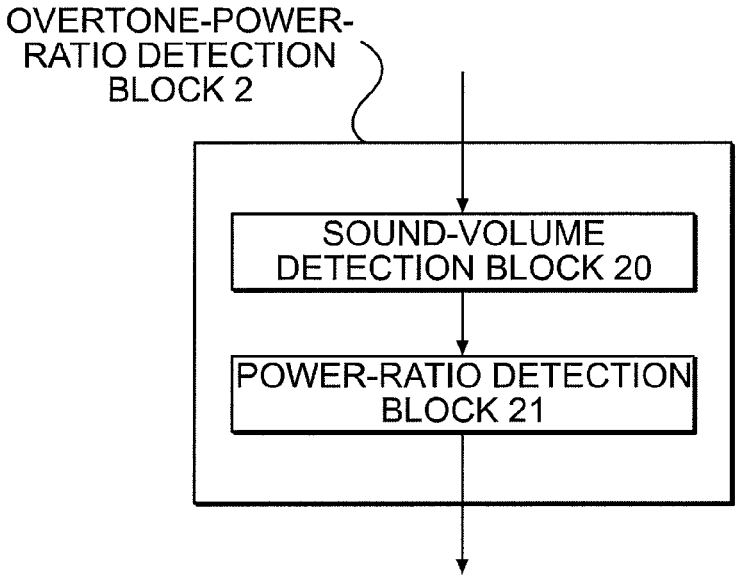
FIG. 2 is a block diagram showing the structure of an overtone-power-ratio detection block.

The overtone-power-ratio detection block 2 includes a sound-volume detection block 20 and a power-ratio detection block 21, as shown in FIG. 2.

The sound-volume detection block 20 measures the sound volume of the input digital signal.

The power-ratio detection block 21 performs an FFT operation on the input digital signal and measures the overtone-to-fundamental power ratio.

The overtone-power-ratio detection block 2 performs the processing each time a predetermined number of A/D converted waveform samples are accumulated. This number is determined by the number of FFT points in the power-ratio detection block 21. To take more detailed data, the FFT window is overlapped. When a ¾ window overlap is used, for instance, the window shift amount is ¼ of the window size, and accordingly, the overtone-power-ratio detection block 2 performs the processing each time data corresponding to ¼ of the window size is accumulated.

The time for performing the processing once is referred to as one frame. In this embodiment, the window size of the overtone-power-ratio detection block 2, that is, the number of FFT points, is 4096. Accordingly, the window size is about 372 ms, and when a ¾ overlap is used, a single frame is about 93 ms.

The sound volume measurement in the sound-volume detection block 20 will be described next.

The sound-volume detection block 20 receives the waveform data of the FFT window size and measures the sound volume.

The sound volume is calculated by taking the square root of the sum of the squares of the amplitudes of the waveforms. With the i-th waveform sample represented as W(i), the sound volume AMP is calculated as given by Expression 1 below:

$$\mathrm{Amp} = \sqrt{\sum_{i=0}^{N-1} W(i)^2}$$

where N is the number of sample waveforms subjected to sound volume calculation, and N=4096.

The processing in the power-ratio detection block 21 will be described next. The power-ratio detection block 21 receives the waveform data of the FFT window size and has a function to measure the overtone-to-fundamental power ratios.

The pitches of some fundamental notes discretely selected in the target range of automatic music transcription are given to the power-ratio detection block 21 from the outside.

The power-ratio detection block 21 measures the power ratios of the second to eighth overtones to the fundamental note, by using the given pitch as the fundamental note.

The power spectrum is obtained as a result of the FFT operation at intervals of about 2.7 Hz in this embodiment, which is obtained by dividing the sampling frequency by the number of FFT points.

This means that the powers at the frequencies of integer multiples of about 2.7 Hz are measured. Powers are not necessarily measured at the same frequency as the fundamental-note frequency or overtone frequencies at which the powers are to be obtained.

In the power spectrum within the range of 50 cents above and below the frequencies of the fundamental note and overtones, the greatest power is assumed to be the power of the fundamental note and overtones. This enables an accurate power ratio to be measured even if the pitch varies to some extent (up to a half of a semitone), so that the automatic music transcription apparatus of the present invention can be applied to musical instruments such as the trumpet, which are difficult to play with a stable pitch.

When a pitch NN (C4: middle C=60) is given, the pitch is converted to a frequency Freq (Hz) as given by Expression 2 below:

$$Cent = (NN - 36) \cdot 100$$

-continued $$Freq = 440 \cdot 2^{\frac{Cent-3300}{1200}}$$

In the expression above, "440" is the frequency of A4. Therefore, the frequency of C3 (note number 48) is 130.8 Hz according to the calculation.

By converting the expression given above, Cent can be calculated from the frequency, as given by Expression 3.

$$Cent = 1200 \cdot \log_2\left(\frac{Freq}{440}\right) + 3300$$

Therefore, the frequency range of 50 cents above and below C3 is from 127.0 Hz to 134.6 Hz according to the calculation.

This is divided by the FFT spectrum interval, and the power of the fundamental note of C3 is obtained by searching for the maximum value through the powers of the 47th to the 50th spectral components.

Figure 3:
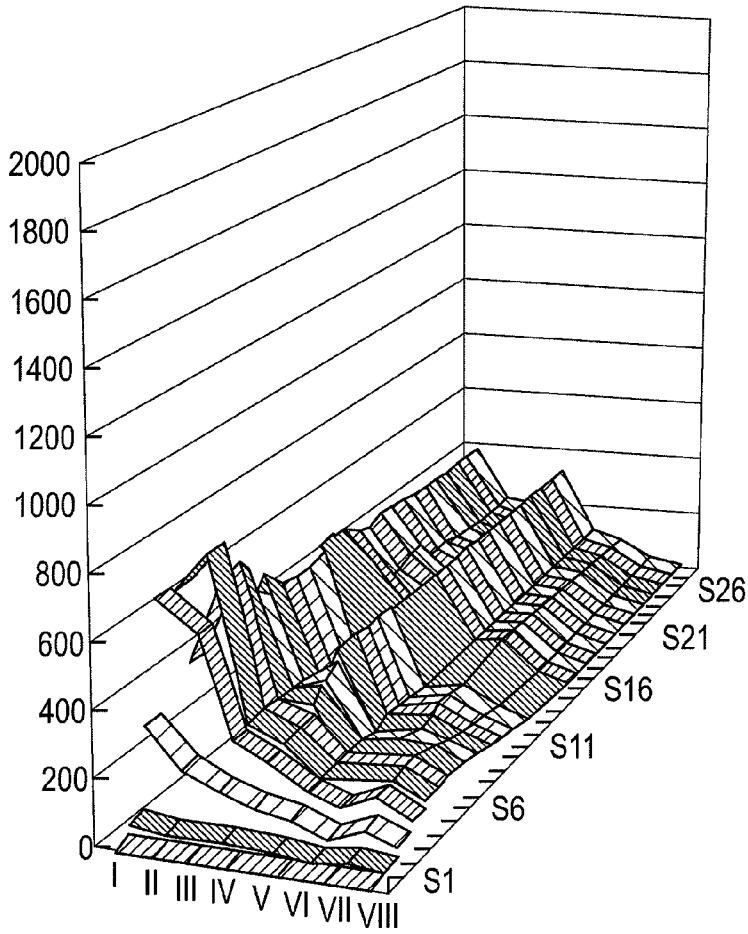
FIG. 3 is a graph showing the powers of a fundamental note and its overtones varying with time after a sound of note number 48 is played on an electric piano.
Figure 4:
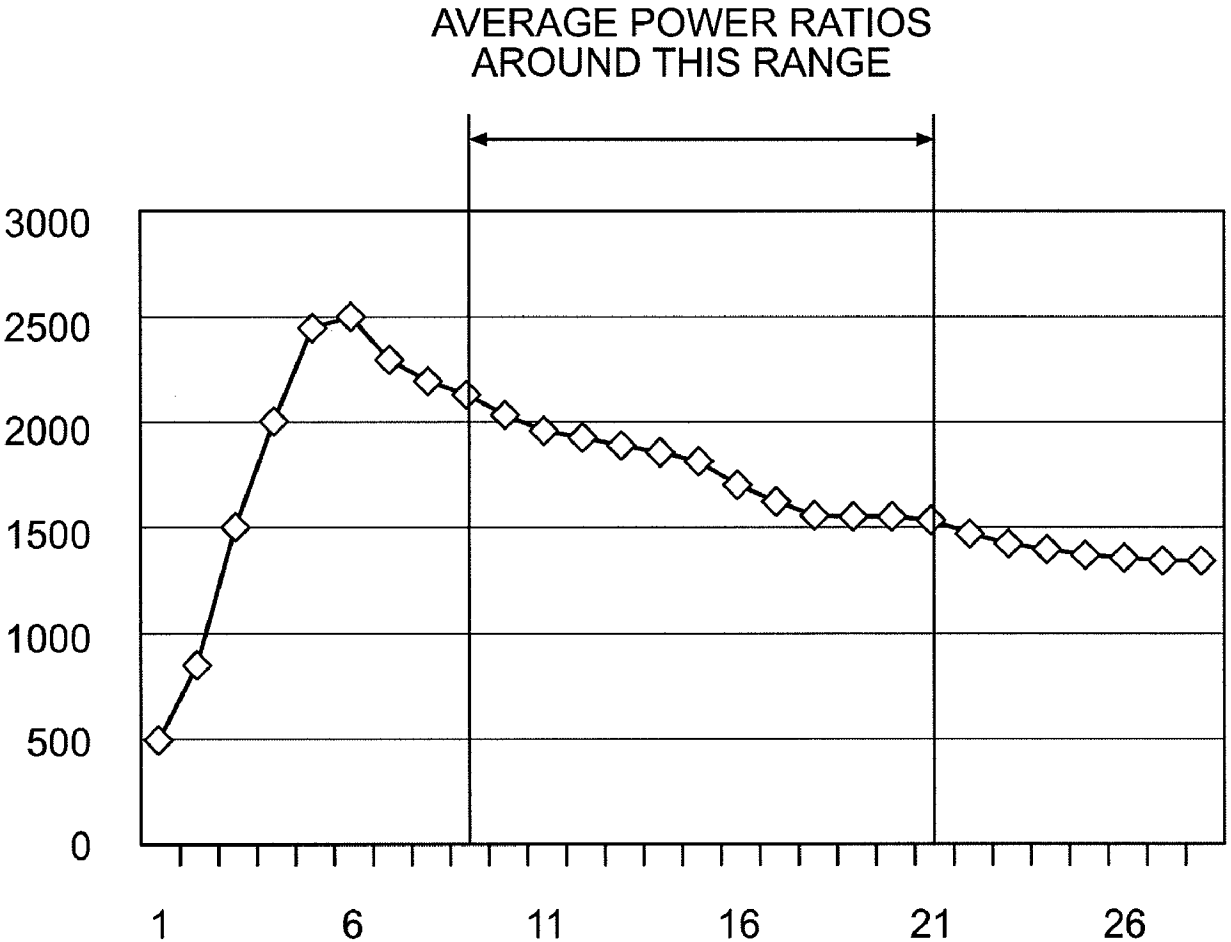
FIG. 4 is a graph showing the volume of the sound varying with time.

FIG. 3 is a graph showing the powers of a fundamental note and its overtones varying with time after the sound of note number 48 is played on a musical instrument (electric piano). FIG. 4 is a graph showing the sound volume varying with time.

In the graph showing the time-varying powers, the vertical axis represents the power, the horizontal axis represents the order of each overtone (I represents the fundamental note, II represents the second overtone, and so on), and the depth axis represents time, which passes from the front to the deepest part (frame numbers are shown). Until the sound volume is maximized in the sixth frame after the key is pressed (attack period), each overtone power greatly varies, making the overtone-to-fundamental power ratio unstable, as shown in the graph.

Then, the overtone powers become stable around the eighth frame and after. Therefore, the power ratio should be measured in that period. Some musical instruments have unstable overtone powers even after the attack period. In such musical instruments, the power ratio should be obtained by taking an average in a certain range (see FIG. 4).

Figure 5:
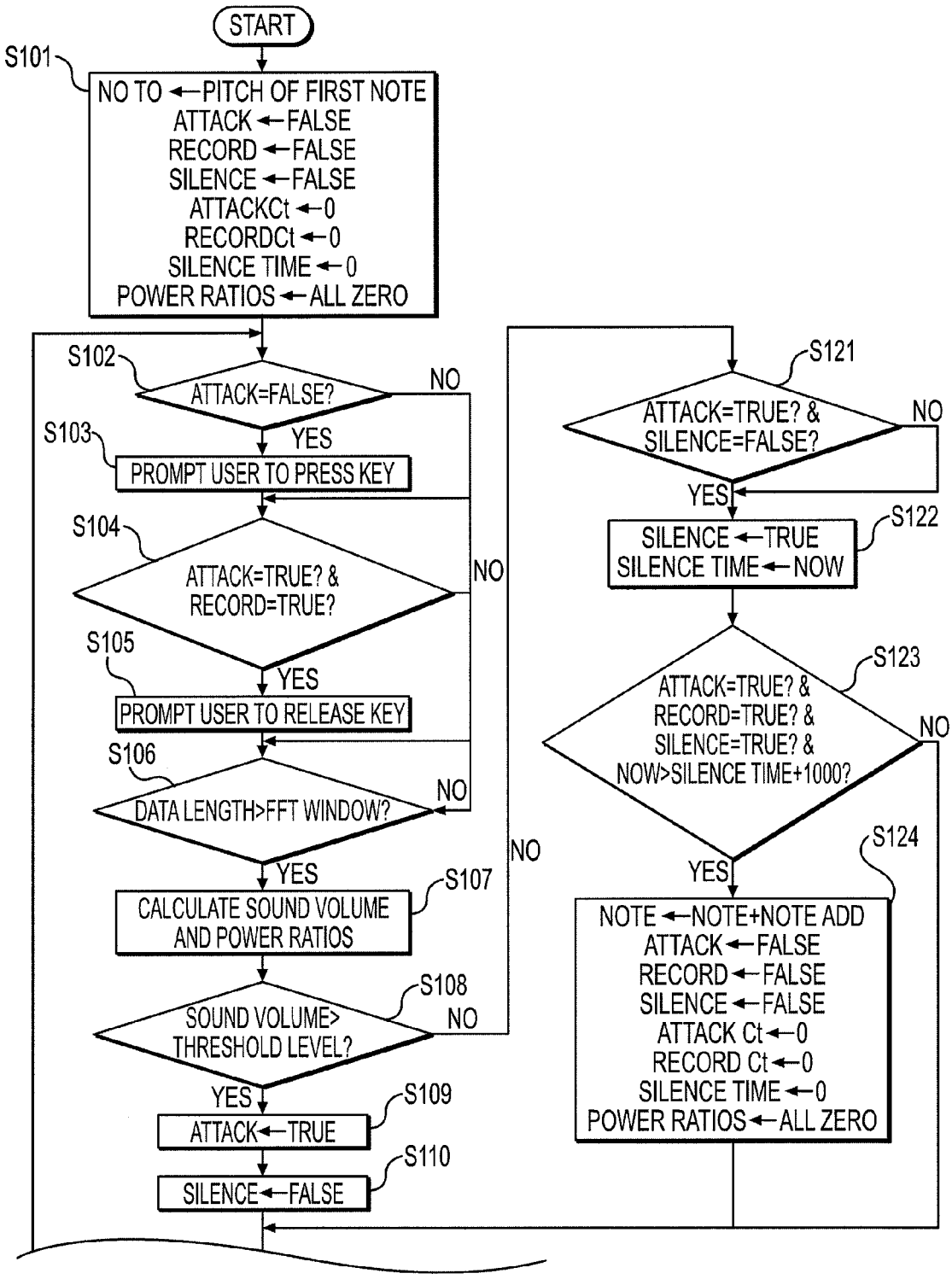
FIG. 5 is a flow chart of processing for detecting an attack on a key, measuring and averaging the power ratios in some frames, storing the power ratios of the chromatic note, and moving on to the next chromatic note.

FIG. 5 is a flow chart of a process for detecting the attack, measuring and averaging power ratios in some frames, storing the power ratio of the chromatic note in the overtone-power-ratio storage block 3, and moving on to the next chromatic note.

The power ratio measurement processing will be described below with reference to the figure. In Step S101, initial values are assigned to variables.

The following variables are used.

Note: Pitch of fundamental note

Attack: Whether the attack is detected or not

Record: Whether the power ratio is stored or not

Silence: Whether the judgment of silence is made

AttackCt: Number of times the attack is detected

RecordCt: Number of times the power ratio is measured

SilenceTime: Time at which the judgment of silence is made

Power ratios: Overtone power ratios from the second to eighth overtones

PASSNUM: Number of frames skipped after the attack is detected and before the power-ratio measurement starts RECNUM: Number of frames in which the power ratio is measured NOTEADD: Pitch interval at which the power ratio is calculated The first pitch at which the power ratio is measured is assigned to Note. To obtain the results as shown in FIG. 6, which will be described later, 48 is specified as the first pitch.

The Attack, Record, and Silence variables are Boolean variables having two values: true (=1) and false (=0). These variables are set to the value of false (=0), indicating that the corresponding events are not detected.

The AttackCt, RecordCt, and SilenceTime variables are also set to zero as initial values.

Figure 6:
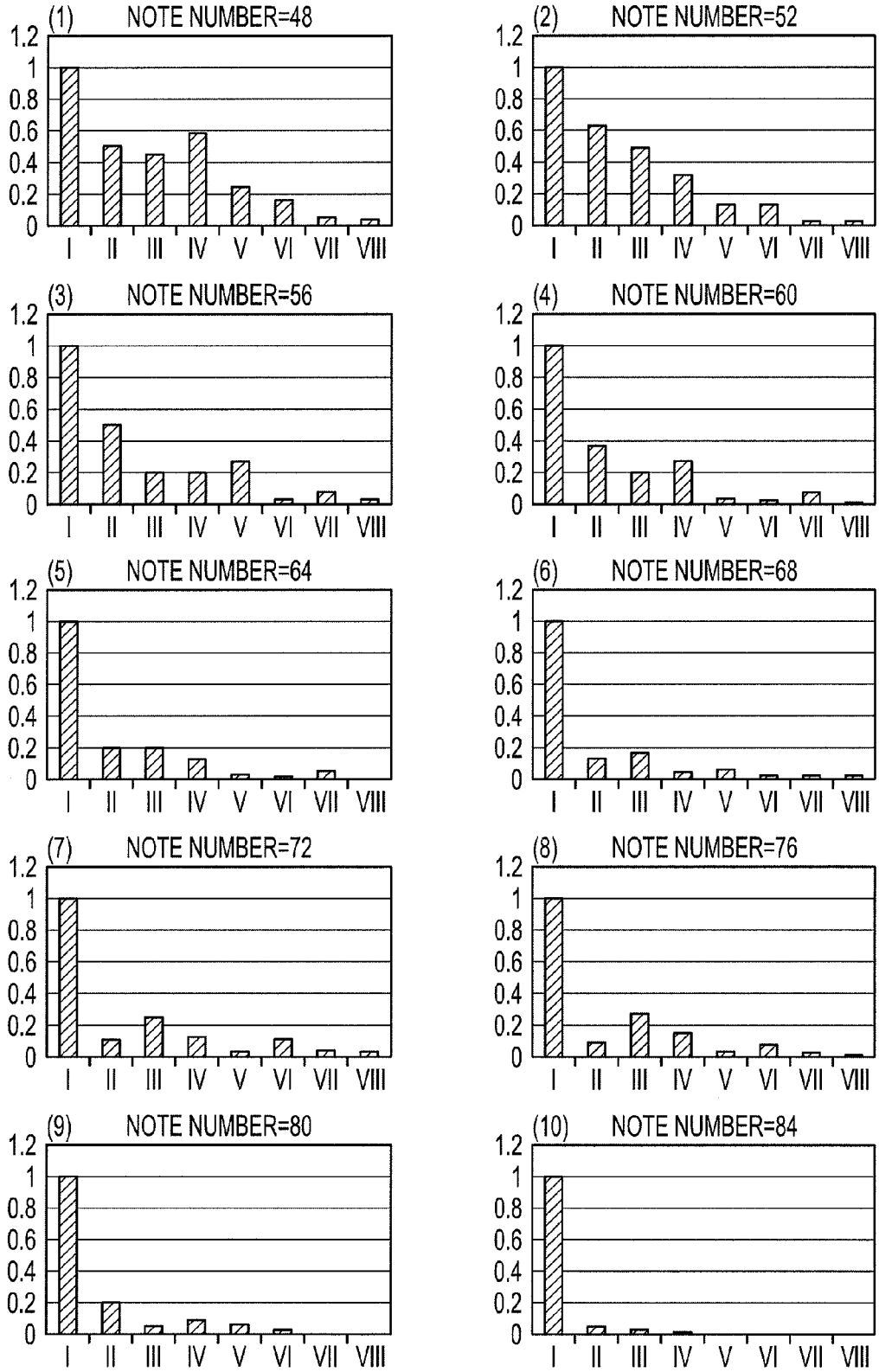
FIG. 6 shows graphs illustrating the overtone power ratios of the electric piano.

The power ratios of up to the eighth overtone are measured in FIG. 6, and this means that a single array has seven elements. Because the overtone power ratios are measured with reference to the fundamental note (=1), the fundamental power ratio is not required. When the overtone power ratios of up to the eighth overtone are measured, there are seven elements. These values are later accumulated for averaging, and the initial value of zero is specified here.

PASSNUM, RECNUM, and NOTEADD are set to fixed values beforehand. In this example, PASSNUM=2, RECNUM=8, NOTEADD=4 are specified.

Since the power ratio is measured in a wide range in this example, PASSNUM is set to such a small value because a high note rises and attenuates rapidly.

After the initial values are set, the processing goes to Step S102. In Step S102, the Attack variable is checked to see whether an attack has already been detected.

If an attack has not yet been detected (Yes in Step S102), the apparatus has not yet detected the pressing of a key and prompts the user to press the key for the pitch of the currently specified Note (in Step S103). This prompt is made on a display unit of the apparatus, a computer display, or the like.

If an attack has already been detected (No in Step S102), the prompt is not required.

The Attack and Record variables are checked to determine whether the release of the key is to be prompted (in Step S104). If an attack has already been detected and if the power ratio has already been stored (Yes in Step S104), further pressing of the key is not required, and the user is prompted to release the key (in Step S105).

The prompt for releasing the key is also made on the display unit of the apparatus, the computer display, or the like.

The processing waits until the A/D-converted waveform samples of the FFT window size are accumulated (in Step S106). After the samples are accumulated (Yes in Step S106), the FFT operation is performed, and the sound volume and the power ratio are measured (in Step S107). The sound volume and the power ratio are measured as described earlier.

In Step S108, it is checked whether the obtained sound volume exceeds a threshold level. If the threshold level is not exceeded (No in Step S108), the processing jumps to a silence judgment stage starting from Step S121.

After the power ratios are measured several times and averaged, it is checked in the silence judgment stage of Step S121 and subsequent steps whether complete silence comes before the next note.

Because an attack has not yet been detected and the power ratio has not yet been stored, the No branch is taken in Steps S121 and S123, and the processing goes to Step S111. The silence judgment processing will be described later in detail.

Because an attack has not yet been detected, the No branch is taken in Step S111 as well (No in Step S111). In the step 118, the No branch is taken again. Since the last note has not yet been reached, of course, the processing returns from Step S120 to Step S102.

The processing waits in Step S106 until the data corresponding to the FFT window size is accumulated. The sound volume and the power ratio are measured in Step S107.

If the user presses the key, the sound volume exceeds the threshold level, the Yes branch is taken in Step S108, and Step S109 is executed.

Because the sound volume has exceeded the threshold level, the attack detection flag Attack is set to "true" in Step S109.

Because the attack has just been detected, the silence detection flag is held to "false" in Step S110.

In Step S111, it is determined whether a frame is to be skipped before the power ratio measurement starts after the attack is detected. If the attack has already been detected, if the power ratio has not yet been stored, and if the count after the detection of attack is smaller than or equal to the value of PASSNUM (2 in this example), the No branch is taken (No in Step S111), and the processing goes to Step S118.

Since the attack has already been detected, the processing proceeds from Step S118 to Step S119. The count after the detection of attack is incremented in Step S119.

The processing from Step S102 is repeated, and when the count after the detection of attack, AttackCt, exceeds PASSNUM (Yes in Step S111), the processing goes to Step S112.

In Step S112, the actual power measurement starts.

The power ratio of each overtone (second to eighth overtones in this example) to the fundamental note is accumulated in the power-ratio buffer (in Step S112), which was initialized to zero in the first step S101. After the buffer was initialized to zero, the power ratios are accumulated in the buffer for averaging to be performed later.

In Step S113, the number of times the power ratios are recorded is incremented.

When the number of times recording is performed reaches a value not less than RECNUM (8 in this example) (Yes in Step S114), the power ratios are averaged (in Step S115).

Since the past power ratios have been accumulated in the power ratio buffer, the average of the power ratios can be obtained just by dividing the sum by the recording count RECNUM.

The averaged power ratio is stored in the overtone-power-ratio storage block 3 (in Step S116).

The power ratio measurement for the pitch is now completed, and the record flag Record is set to "true" (in Step S117).

The silence judgment processing starting from Step S121 after the recording will be described next.

If the recording of the next note starts while the current note remains, the components of the current note would mix with the power spectrum of the next note, making it impossible to obtain a correct power ratio. Since the note continues to reverberate in the piano or other similar musical instruments even after the key is released, the recording of the next note must start after it is confirmed that the current note is sufficiently silenced.

The silence judgment processing is performed in Steps S121 to S124. When the recording is completed, the Record flag is set to "true" (in Step S117). Then, the Yes branch is taken in Step S104, and the user is prompted to release the key in Step S105. Following the prompt, the user releases the key.

Then, the sound volume decreases, and it will be detected in Step S108 that the sound volume becomes equal to or smaller than the threshold level.

Before the sound volume becomes equal to or smaller than the threshold level, the Silence flag is set to "false" in Step S110, and the No branch is taken in Step S111 because the recording has been completed. The count after the attack detection is incremented in Step S119.

Although the same sound volume threshold levels are used in the attack detection and the silence judgment in this example, the two threshold levels may be different.

When it is detected in Step S108 that the sound volume becomes equal to or smaller than the threshold level, the processing goes to Step S121. In Step S121, it is checked first whether an attack has already been detected and whether a silence judgment has ever been made (Silence flag). The Attack flag is checked here because this step is executed even in silence before the key is pressed.

If the silence judgment flag Silence is "false" (Yes in Step S121), the flag is set to "true" here, and the current time is stored in the SilenceTime variable in milliseconds (in Step S122).

In Step S123, it is checked whether the silence state continues for one second or longer. The processing goes to Step S124 if the following conditions are satisfied: an attack has already been detected; the recording has been completed; the silence judgment has been made once or more; and a period of 1000 milliseconds, namely, 1 second, has elapsed after the first silence judgment (Yes in Step S123).

The fact that the processing goes to Step S124 means that the whole processing of the pitch has been completed. The pitch of the next note is specified, and all other variables are initialized.

If the sound volume exceeds the threshold level even once during the silence judgment, the Yes branch is taken in Step S108, and the Silence flag is set to "false" again in Step S110.

When the sound volume becomes equal to or smaller than the threshold level next, the start time of the silence judgment is set again in Step S122.

Now, it can be determined that the sound volume has remained equal to or smaller than the threshold level for one second or longer and that complete silence has come.

The reason why it is decided whether the silence state continues for one second or longer is that, in the piano and other similar musical instruments, the sound volume rises and falls while it is attenuated, and that the sound volume may exceed the threshold level again after it becomes equal to or smaller than the threshold level once.

When the pitch exceeds the pitch of the final note in Step S120, the processing ends.

After the power ratios for all chromatic notes to be measured are obtained, the overtone-power-ratio storage block 3 stores the power ratios in an external storage device (flexible disk or the like).

The power-ratio measurement does not need to be executed each time automatic music transcription is performed. It is thought that the measurement should be performed generally once for one musical instrument if the power ratios of the same note do not change greatly. Accordingly, the overtone power ratios may be measured prior to automatic music transcription, and stored overtone power ratios may be read and used.

FIG. 6 shows overtone power ratios measured as described above on a musical instrument (electric piano). In this example, the power ratios were measured at the intervals of major third (four semitones) in the range of three octaves from C3 to C6.

As shown in the figure, the overtone power ratios vary almost smoothly with pitch. The power ratios for the pitches of note numbers 49 and 51, which were not measured, are expected to be similar to the power ratios for the pitches of note numbers 48 and 52. Therefore, the power ratios for a close pitch may be used as those power ratios. Alternatively, intermediate power ratios obtained as a proportion of the power ratios for higher and lower pitches may be used.

After the overtone power ratios are prepared, automatic music transcription can be started. The automatic music transcription processing will be described next.

The sound played by a musical instrument is digitalized by the A/D conversion block 11, and the power of each chromatic note is measured by the chromatic-note-power detection block 4.

The chromatic-note-power detection block 4 measures the power of each chromatic note by using the same method as used by the overtone-power-ratio detection block 2. That is, the maximum value of power is detected in the power spectrum within the range of 50 cents above and below the fundamental frequency of each chromatic note.

In order to measure accurate power in a wider range, the number of FFT points is set to 8192, and the window overlap value is set to 15/16. The frequency resolution becomes about 1.3 Hz, and the time resolution (time of one frame) becomes about 46 ms, which corresponds to the duration of a thirty-second note in a musical piece having a tempo of about 163 quarter notes per minute.

The range of chromatic notes to be detected is specified in accordance with the range of a musical instrument whose music is to be automatically transcribed. The range may be further limited in accordance with the range of a musical piece to be transcribed.

Suppose that the range is three octaves from C3 to C6. The FFT operation is performed once every frame time with the parameters given above, and the powers of the chromatic notes from C3 to C6 (C3, C#3, D3, . . . B5, C6) are obtained accordingly.

Figure 7:
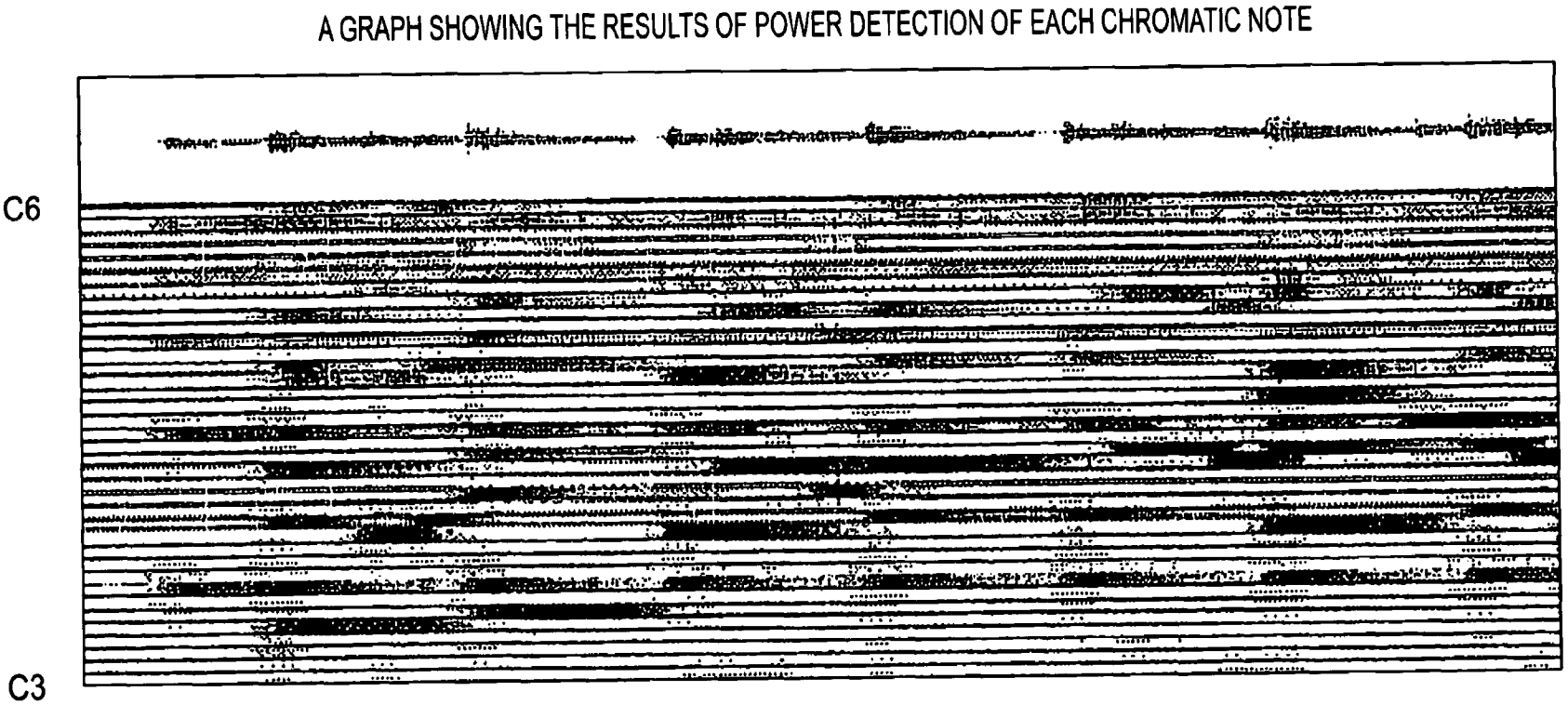
FIG. 7 is a graph showing the results of power detection of each chromatic note.

FIG. 7 shows the results of power detection of each chromatic note. In FIG. 7, the waveform is shown in the upper row, and the power of each chromatic note is represented by gradations in the lower row.

Figure 8:
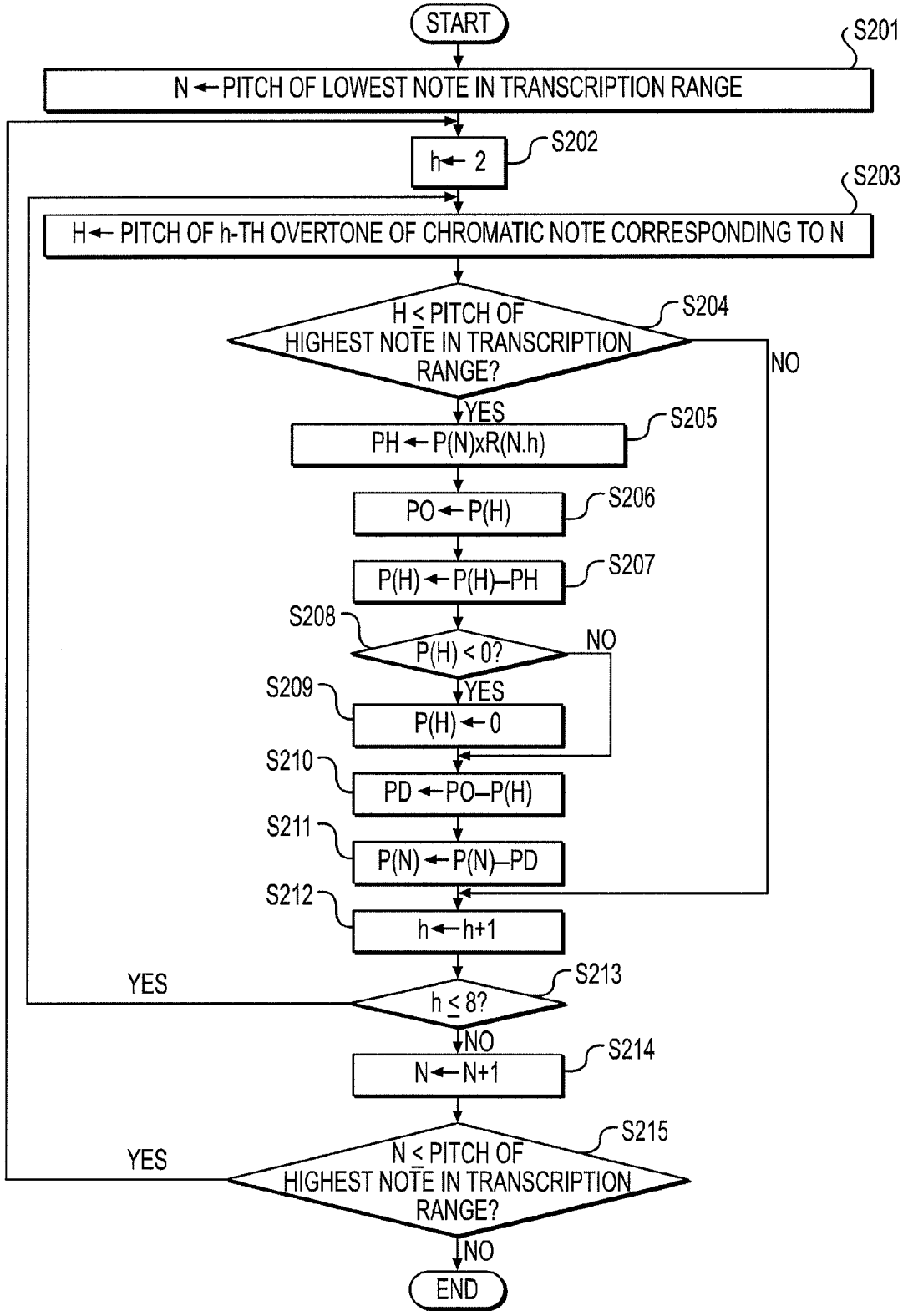
FIG. 8 is a flow chart showing the procedure for eliminating overtone components.

After the powers of the chromatic notes are detected, the overtone-to-fundamental power ratios of the chromatic notes of the same musical instrument, which are stored beforehand, are used to eliminate the overtone components. This procedure is shown in the form of flow chart in FIG. 8.

A variable N represents the pitch of a chromatic note to be transcribed, within the range of C3 (48) to C6 (84) in this example. A variable h represents the overtone order, which varies from 2 to 8. A variable H represents the pitch of the h-th overtone of the chromatic note corresponding to N. If H exceeds the pitch of C6, the subsequent processes are not performed. A variable P(N) represents the power of the chromatic note corresponding to N, and a variable R(N, h) represents the power ratio of the h-th overtone of the chromatic note corresponding to N.

In Step S201, the variable N is set to the pitch of the lowest note in the target transcription range. In this example, where the transcription range is C3 to C6, the pitch of the lowest note is "48".

In Step S202, "2" is assigned to the variable h. The variable h represents the order of the overtone. Because the second to eighth overtones are processed in this example, "2" is specified first.

In Step S203, the pitch of the h-th overtone of the chromatic note corresponding to N is assigned to the variable H. The pitch "60" of the second overtone of the chromatic note corresponding to the pitch "48" is specified in this example.

The pitch of the h-th overtone of the chromatic note corresponding to N is obtained by converting N (reference pitch) into a frequency, multiplying the frequency by h, and converting the result to a pitch again.

If H exceeds the transcription range (No in Step S204), the power of the corresponding chromatic note is not calculated, and the subsequent processes cannot be performed.

The overtone elimination processing is performed only when H is within the transcription range (Yes in Step S204).

Steps S205 to S211 constitute the core of the overtone elimination processing.

In Step S205, the power of the pitch N is multiplied by the stored power ratio of the h-th overtone of the chromatic note corresponding to the pitch N. This multiplication provides the assumed power of the h-th overtone of the fundamental note corresponding to N. The calculated result is stored as a variable PH (in Step S205).

In Step S206, the current power of the pitch H, that is, the current power of the h-th overtone of the chromatic note corresponding to N, is stored as a variable PO for use in later processing.

In Step S207, PH is subtracted from the power of the pitch H, that is, the power of the h-th overtone of the chromatic note corresponding to N. PH represents the assumed power of the h-th overtone, and the overtone component is eliminated by subtracting PH.

The power must not be a negative value. If a negative value is obtained in Step S208 or S209, the value is set to zero.

In Step S210, the current power P(H) of H is subtracted from the stored power PO of H, that is, the stored power of the h-th overtone of the chromatic note corresponding to N. The subtracted power value is stored as PD.

The PD value is added to the power of N (in Step S211). The overtone component is added to the fundamental note so that a fundamental note having a lower power than its overtones, as in the low range of the piano, can be detected.

The overtone elimination processing is performed as described above, and h is incremented in Step S212 to handle the next overtone.

If h is 8 or less (Yes in Step S213), the processing goes back to Step S203, and the overtone elimination processing is repeated. If h exceeds 8 (No in Step S213), the processing goes to Step S214.

In Step S214, N is incremented to process the next chromatic note.

In Step S215, it is checked whether N is within the transcription range. If the processing should be continued (Yes in Step S215), the processing goes back to Step S202, where h is initialized to 2.

If N exceeds the transcription range (No in Step S215), the processing ends. As described above, the product of the power of the chromatic note corresponding to N and the power ratio of the h-th overtone of the chromatic note corresponding to N is subtracted from the power P(H) of the h-th overtone, and the product is added to the power P(N) of the chromatic note corresponding to N.

Figure 9:
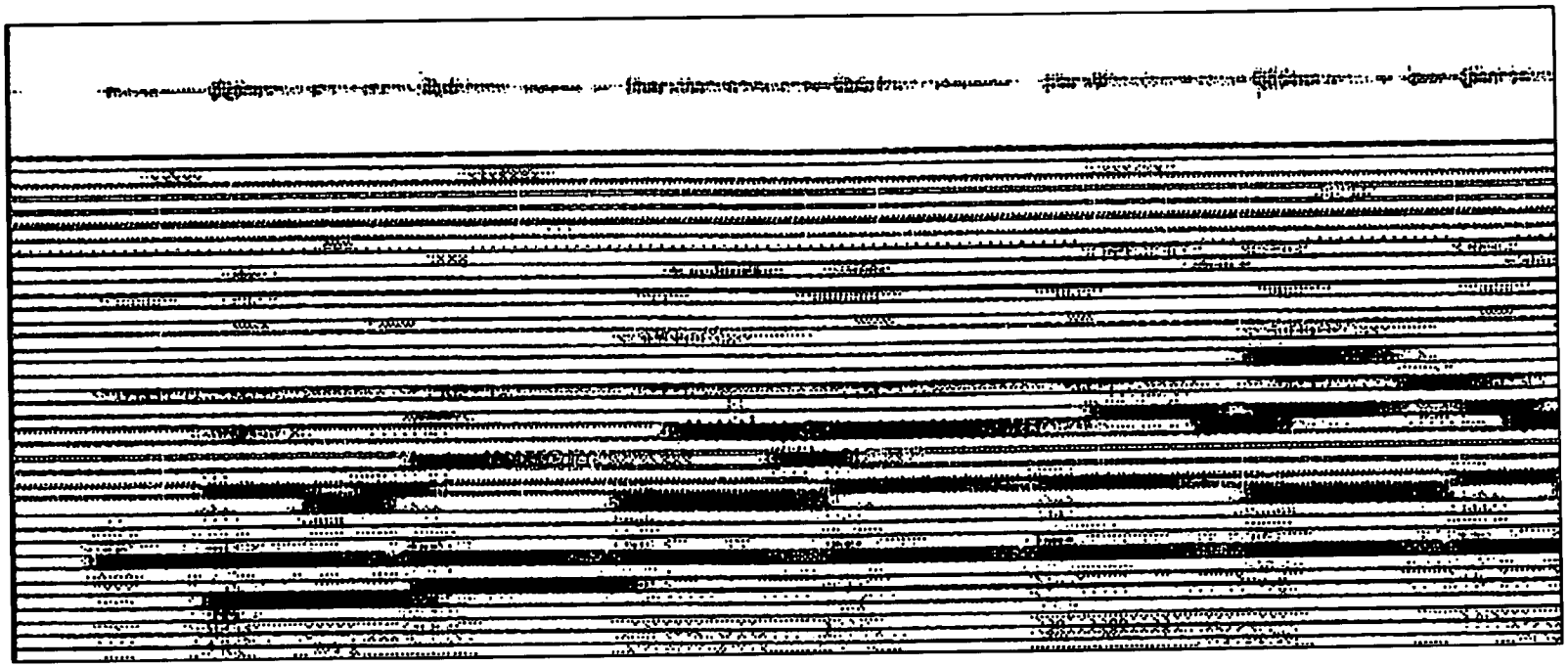
FIG. 9 is a graph showing the power of each chromatic note after the power of the eliminated overtone component is added to the power of the fundamental note.

FIG. 9 shows the power of each chromatic note after the overtone components are eliminated and the powers of the eliminated overtone components are added to the power of the fundamental note.

Portions having powers equal to or higher than a certain threshold level are extracted from the power of each chromatic note after overtone elimination, and musical notation information is generated therefrom and output.

The threshold level is, for instance, one that is obtained by detecting the maximum value of power from all the frames of all the chromatic notes and by multiplying the detected maximum value by a certain coefficient, such as 0.3. The user may specify the coefficient in accordance with the note detection condition.

Figure 10:
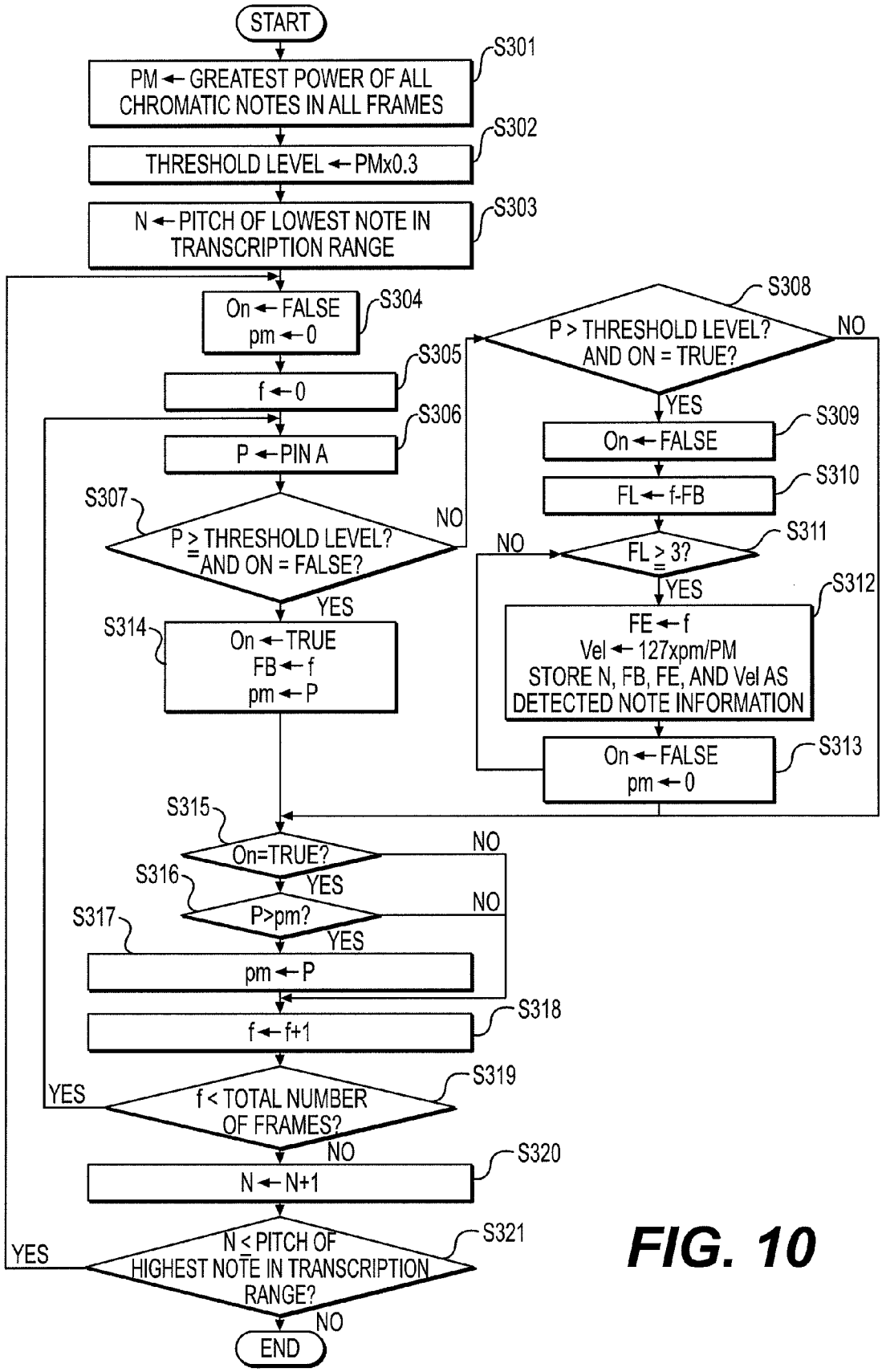
FIG. 10 is a flow chart showing the procedure of note detection processing.

FIG. 10 shows a flow chart of note detection processing.

In Step S301, the maximum value of power detected from all the frames of all the chromatic notes is calculated and assigned to a variable PM.

The value assigned to PM may be the average value of the powers instead of the maximum value of the powers. If the average value is assigned, the coefficient used in Step S302, which is 0.3 in this example, should be an appropriately greater value.

In Step S302, the threshold level of note detection is determined. The threshold level is obtained by multiplying the coefficient (0.3 in this example) by PM.

After the threshold level is obtained, the note detection processing starts.

In Step S303, the pitch of the lowest note in the transcription range is specified as the initial value of the pitch to be transcribed.

In Step S304, variables used in the transcription processing are initialized. A variable On is a Boolean variable representing the beginning of a note (note on) and is initially set to "false". A variable pm represents the maximum value of the power of the detected note and is initially set to zero.

In Step S305, another variable f is initialized to zero. The variable f represents a frame number.

In Step S306, the power of the f-th frame of the chromatic note to be transcribed corresponding to N is assigned to a variable P. If P is greater than or equal to the threshold level and if the On flag remains "false" (Yes in Step S307), the processing goes to Step S314.

In Step S314, the On flag is set to "true", the current frame number f is assigned to a variable FB representing the first frame of note detection, and the current power P is assigned to pm representing the power of the note.

Steps S315 to S317 constitute pm update processing. If the On flag is "true", that is, if note detection has started (Yes in Step S315), it is checked whether the current power P is greater than pm (in Step S316). If P is greater than pm, pm is updated to P (in Step S317).

In Step S318, the current frame number f is incremented. In Step S319, if f is smaller than the total number of frames (Yes in Step S319), the processing returns to Step S306, and the same processing is repeated. If f is greater than or equal to the total number of frames (No in Step S319), the processing goes to Step S320, where the pitch N of the chromatic note to be detected is incremented.

In Step S321, if N is within the range to be transcribed (Yes in Step S321), the processing returns to Step S304, and the variables are initialized. If N is beyond the range (No in Step S321), the processing ends.

Steps S308 to S313 will be described next.

Once the note detection starts, the On flag is set to "true" in Step S314, and the No branch is taken in Step S307.

In Step S308, note-off is detected. It is checked whether the power P is below the threshold level. If the power P falls below the threshold level (Yes in Step S308), the processing goes to Step S309.

In Step S309, the On flag is set to "false".

In Step S310, the duration FL of the detected note is obtained by calculating (f−FB).

In Step S311, if the duration FL is shorter than three frames (No in Step S311), the processing jumps to Step S313. If the duration FL is sufficiently long (Yes in Step S311), the detected note is finalized, a note detection end frame FE is set to the current frame number f, and a velocity Vel is obtained by calculating 127×pm/PM. The detected pitch N, the detection start frame FB, the detection end frame FE, and the velocity Vel are stored in the buffer as the detected note information (in Step S312).

Step S313 is performed if the duration of the detected note is too short. The On flag is initialized to "false", the maximum value pm of the power is initialized to zero, and detection of the next note is waited for.

As described above, each chromatic note is detected from its first frame to the last frame if it continues for a certain period of time with its power being greater than or equal to the threshold level.

For each chromatic note corresponding to N, it is checked from its first frame to the last frame whether the power P(N, f) in each frame f continues to be greater than or equal to the threshold level. The period from the point (FB) where the power reaches the threshold level to the point (FE) where the power falls below the threshold level is taken as the duration of the note. The data of a note having a duration shorter than three frames are deleted, and a note having a longer duration is stored as a detected note. From pm, which is the maximum power in the duration of the note, and the maximum value PM of the power in all the frames of all the chromatic notes, the velocity of the note (strength of the note) is calculated.

In the example shown in FIG. 10, the velocity is determined from the maximum value of the power. The velocity may be calculated from the average value of the powers.

The enclosed part in FIG. 9 shows the detected notes. The detected musical notation information is sorted by the detection result output block 7 in the order in which the notes are produced and is output to a file such as a standard midi file (SMF). The automatic music transcription apparatus may also play the music.

In the structure of the embodiment, described above in detail, the overtone-to-fundamental power ratio is provided in advance with respect to some chromatic notes produced by the musical instrument used in the music to be automatically transcribed; the overtone power ratios of the other chromatic notes are generated through interpolation in accordance with the available power ratios given to a higher or lower chromatic note or both higher and lower chromatic notes; the power of each chromatic note is detected from the input acoustic signal; on the assumption that each chromatic note is a fundamental note, the product of the power of the fundamental note and the power ratio of each overtone corresponding to the chromatic note of the fundamental note is subtracted from the power of the chromatic note of the overtone, and the product is added to the power of the fundamental note, with respect to all the chromatic notes, one after another from the lowest chromatic note; and then the musical notation information is detected by extracting a chromatic note having a power greater than or equal to the threshold level.

Accordingly, an acoustic signal produced by a single musical instrument, not only in monophonic music but also in polyphonic music, where a plurality of notes are sounded at the same time, can be transcribed automatically.

The automatic music transcription apparatus of the present invention is not limited to the example described above with reference to the drawings. It is of course possible to make various modifications without departing from the scope of the present invention.

The automatic music transcription apparatus and the program for implementing the functions according to the present invention can be used in a variety of fields, such as automatic music transcription apparatuses, the creation of music databases, research on music structure and the like, automatic accompaniment systems, session systems, and music lesson systems.

What is claimed is:

1. An automatic music transcription apparatus comprising:

input means for receiving an acoustic signal;

overtone-power-ratio detection means for detecting beforehand overtone-to-fundamental power ratios of an input sample acoustic signal of a musical instrument used in music to be transcribed automatically;

storage means for storing the overtone-to-fundamental power ratios;

chromatic-note-power detection means for detecting the power of each chromatic note from the acoustic signal input from the musical instrument;

overtone elimination means for subtracting, on the assumption that each chromatic note is a fundamental note, the product of the power of the fundamental note and the power ratio of each overtone corresponding to the chromatic note of the fundamental note from the power of the chromatic note of the overtone and adding the product to the power of the fundamental note, with respect to all the chromatic notes, one after another from the lowest chromatic note; and musical-notation-information detection means for detecting musical notation information by extracting a chromatic note having a power greater than or equal to a threshold level after the overtone elimination means performs the processing.

2. The automatic music transcription apparatus according to claim 1, wherein the overtone-power-ratio detection means detects the overtone-to-fundamental power ratios, by using overtone-to-fundamental power ratios provided for some chromatic notes beforehand, by generating overtone-to-fundamental power ratios of the other chromatic notes through interpolation in accordance with the available power ratios given to a higher or lower chromatic note or both higher and lower chromatic notes, and by outputting the overtone-to-fundamental power ratios of the chromatic notes.

3. An automatic music transcription program for making a computer serve as:

input means for receiving an acoustic signal;

overtone-power-ratio detection means for detecting beforehand overtone-to-fundamental power ratios of an input sample acoustic signal of a musical instrument used in music to be transcribed automatically;

storage means for storing the overtone-to-fundamental power ratios;

chromatic-note-power detection means for detecting the power of each chromatic note from the acoustic signal input from the musical instrument;

overtone elimination means for subtracting, on the assumption that each chromatic note is a fundamental note, the product of the power of the fundamental note and the power ratio of each overtone corresponding to the chromatic note of the fundamental note from the power of the chromatic note of the overtone and adding the product to the power of the fundamental note, with respect to all the chromatic notes, one after another from the lowest chromatic note; and musical-notation-information detection means for detecting musical notation information by extracting a chromatic note having a power greater than or equal to a threshold level after the overtone elimination means performs the processing.

4. The automatic music transcription program according to claim 3, wherein the overtone-power-ratio detection means detects the overtone-to-fundamental power ratios, by using overtone-to-fundamental power ratios provided for some chromatic notes beforehand, by generating overtone-to-fundamental power ratios of the other chromatic notes through interpolation in accordance with the available power ratios given to a higher or lower chromatic note or both higher and lower chromatic notes, and by outputting the overtone-to-fundamental power ratios of the chromatic notes.

* * * * *